US008596307B2

(12) United States Patent
Krulitsch et al.

(10) Patent No.: US 8,596,307 B2
(45) Date of Patent: Dec. 3, 2013

(54) METHOD FOR FILLING CONTAINERS WITH A FILLING MATERIAL CONSISTING OF AT LEAST TWO COMPONENTS, FILLING POINT AND FILLING MACHINE FOR CARRYING OUT SAID METHOD

(75) Inventors: Dieter-Rudolf Krulitsch, Bad Kreuznach (DE); Manfred Härtel, Bretzenheim (DE)

(73) Assignee: KHS GmbH, Dortmund (DE)

( * ) Notice: Subject to any disclaimer, the term of this patent is extended or adjusted under 35 U.S.C. 154(b) by 403 days.

(21) Appl. No.: 12/918,132

(22) PCT Filed: Feb. 5, 2009

(86) PCT No.: PCT/EP2009/000783

§ 371 (c)(1),
(2), (4) Date: Aug. 18, 2010

(87) PCT Pub. No.: WO2009/103426

PCT Pub. Date: Aug. 27, 2009

(65) Prior Publication Data

US 2011/0000578 A1 Jan. 6, 2011

(30) Foreign Application Priority Data

Feb. 19, 2008 (DE) ..... 10 2008 010 078

(51) Int. Cl.
*B65B 1/04* (2006.01)

(52) U.S. Cl.
USPC ..... 141/9; 141/99; 141/102; 141/105

(58) Field of Classification Search
USPC ..... 141/9, 90, 99, 100–102, 104, 105, 107
See application file for complete search history.

(56) References Cited

U.S. PATENT DOCUMENTS

| | | | | |
|---|---|---|---|---|
| 5,829,476 | A | 11/1998 | Kaneko | |
| 5,992,455 | A * | 11/1999 | Koller et al. | 137/606 |
| 6,267,157 | B1 * | 7/2001 | Gruson et al. | 141/90 |
| 6,546,970 | B2 * | 4/2003 | Gatteschi | 141/106 |
| 6,644,363 | B2 * | 11/2003 | Sogliani et al. | 141/83 |
| 8,256,474 | B2 * | 9/2012 | Stienen | 141/144 |
| 2005/0183393 | A1 | 8/2005 | Engesser et al. | |

FOREIGN PATENT DOCUMENTS

| | | |
|---|---|---|
| DE | 29617228 | 10/1997 |
| DE | 20004954 | 2/2002 |
| DE | 202004010515 | 10/2004 |
| EP | 0 919 472 A | 6/1999 |
| EP | 1 243 546 A | 9/2002 |
| GB | 2 178 015 A | 2/1987 |
| WO | 94/24037 | 10/1994 |
| WO | 00/20327 A | 4/2000 |
| WO | 2007/039074 | 4/2007 |

* cited by examiner

*Primary Examiner* — Jason K Niesz
(74) *Attorney, Agent, or Firm* — Occhiuti Rohlicek & Tsao LLP

(57) ABSTRACT

The invention relates to a method for filling containers (3) with a filling material consisting of at least two components that are introduced separately into the respective container (3), with the aid of a filling element (1, 1*a*).

10 Claims, 7 Drawing Sheets

1
8
A
10
11
9
B
3
2
5
a
b
c
d 11a
9
11
8
FA
3
6a
A
10
2
5
a
b
c
d

METHOD FOR FILLING CONTAINERS WITH A FILLING MATERIAL CONSISTING OF AT LEAST TWO COMPONENTS, FILLING POINT AND FILLING MACHINE FOR CARRYING OUT SAID METHOD

CROSS-REFERENCE TO RELATED APPLICATIONS

This application is the National Stage of International Application No. PCT/EP2009/000783, filed on Feb. 5, 2009, which claims the benefit of German Application No. 10 2008 010 078.1, filed on Feb. 19, 2008, the contents of both of the foregoing applications are hereby incorporated by reference in their entirety.

FIELD OF DISCLOSURE

The invention relates to a method for filling containers, for example bottles, cans or similar, with a filling material consisting of two components, to a filling point for controlled dispensing of the filling material into containers, and to a filling machine having several such filling points.

SUMMARY

The problem of the invention is to demonstrate a method with which containers can be filled easily with a filling material consisting of at least two components, in particular with reproducible proportions of the components in the containers.

According to the invention, the components are each introduced separately into the container, so that any amalgamation and/or mixing of these components only takes place in the respective container. Preferably the components are introduced in each filling cycle in chronological sequence into the container concerned, so that the filling quantity (filling quantity) assigned to each component can be introduced into the respective container in an exactly controlled or adjusted fashion and, as a result, reproducible conditions, and especially in relation to the proportions (quantity or volume percent or ratio) of the components ensue in the respective filled container.

In one preferred embodiment of the invention, the filling of each container with all the components to be introduced into the respective container occurs at one and the same filling point or using one and the same filling element, and preferably using a filling element with at least one dispensing opening to dispense the filling material, at least one gas trap being assigned to the dispensing opening. At the end of each filling cycle, the sequentially last component of each filling cycle remains in the fluid channel or fluid channel segment formed above the gas trap in the filling element, i.e. it is filled with the component introduced into a container at the end of the filling cycle. This sequentially last component then forms the sequentially first in the subsequent filling cycle, i.e. the component to be introduced first into the respective container.

A filling cycle within the meaning of the invention is that cycle or that filling sequence in which the individual components are introduced into the respective container, and preferably in the initially empty container, which at the end of the filling cycle is filled with the necessary filling quantity or to the necessary fill level.

The particular advantages of the invention consist e.g. in the fact that the individual components are reproducibly introduced into the containers with great accuracy. There is also the option with the invention of equipping the filling elements used, in the area of their dispensing openings, with gas traps, which are traversed during filling by the filling material and enable the respective filling cycle to be completed without emptying the filling elements or their fluid channels and without the risk of dripping by the filling material.

In particular, by the presence of just one gas trap, the opening cross section of the container can be optimally used and nevertheless almost no concessions need be made with respect to the determination (weight) and delimitation (mixing in the pipeline) of different fluid phases.

Refinements, advantages and potential applications of the invention will also become apparent from the following description of exemplary embodiments and from the figures. Here all the features described and/or graphically illustrated, per se or in whatsoever combination, are in principle the subject matter of the invention, regardless of their summary in the claims or back-references thereto. The content of the claims is also an integral part of the description.

BRIEF DESCRIPTION OF THE FIGURES

The invention will next be described in more detail on the basis of the figures showing exemplary embodiments. The figures show.

DETAILED DESCRIPTION

Figure 1:
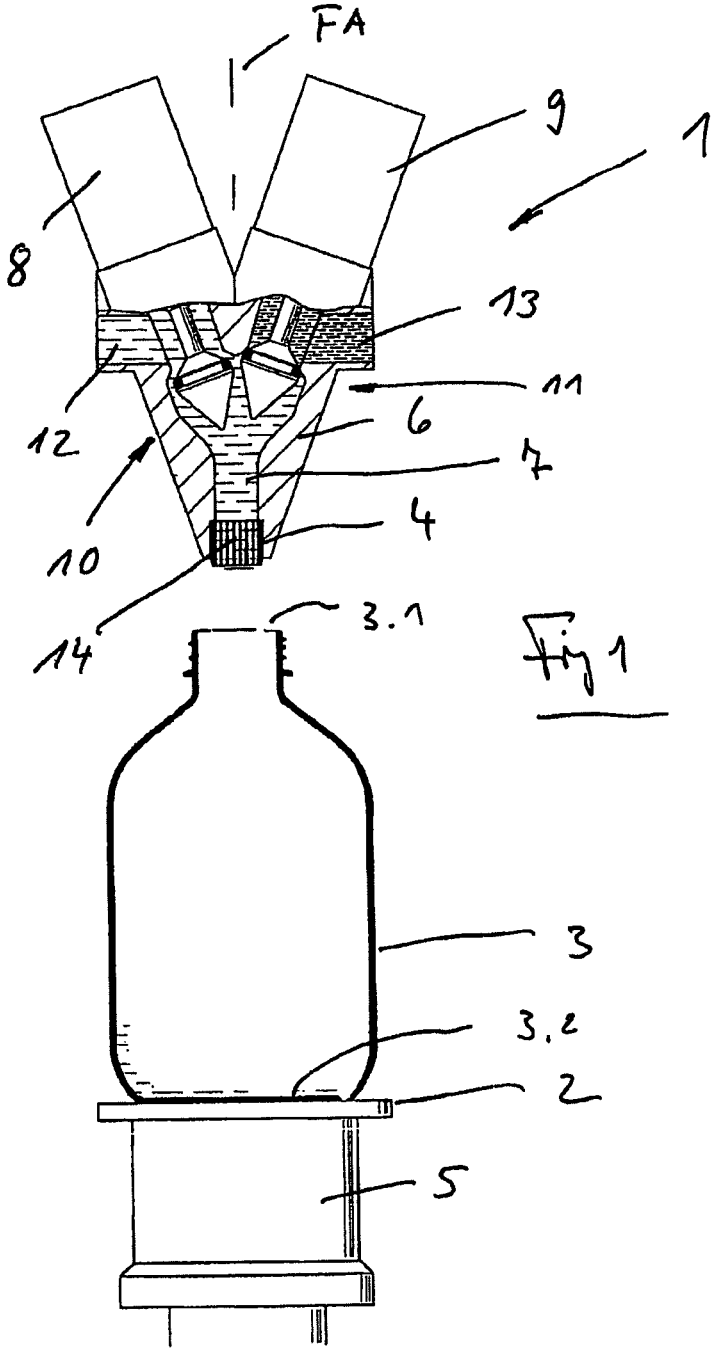
FIG. 1 in simplified view, a filling element together with a container in the form of a bottle.
Figure 2:
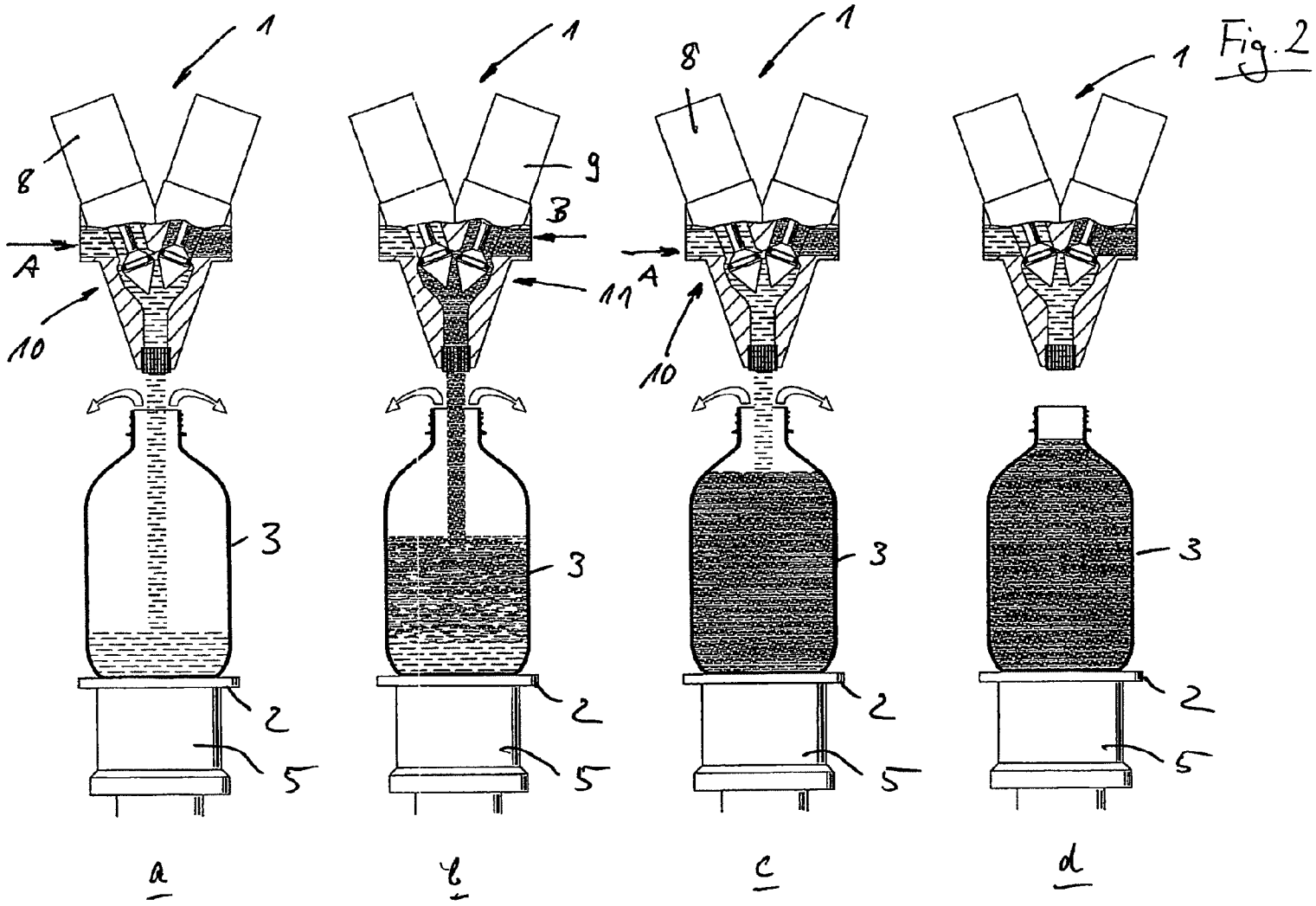
FIG. 2 positions *a*)-*d*) each show in diagram form a filling point with the filling element from FIG. 1 and the container in the form of a bottle at various stages of the filling process or of a filling cycle.
Figure 3:
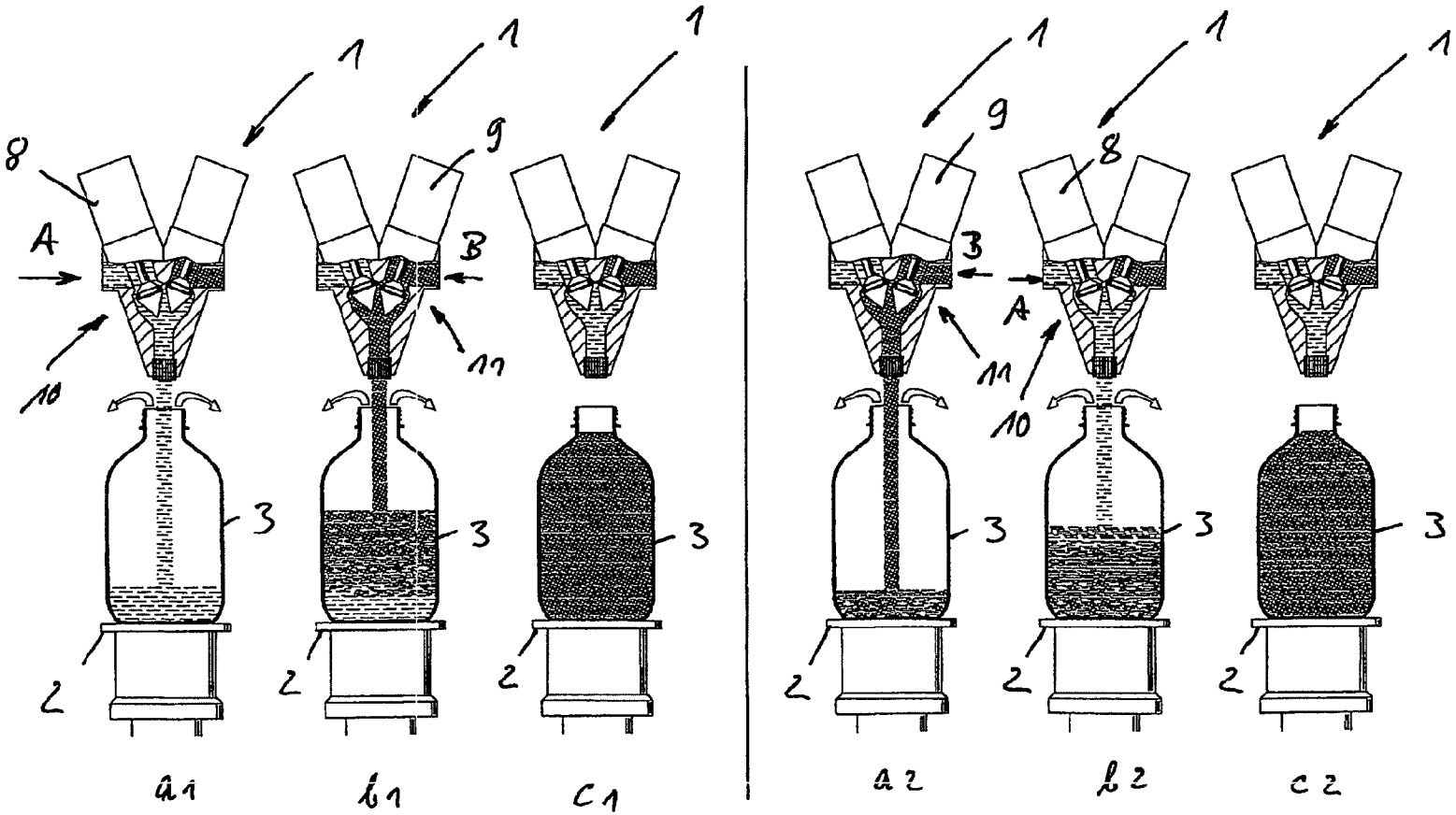
FIG. 3 positions *a*1)-*c*1) and *a*2)-*c*2) each show different steps of two consecutive filling cycles in a further embodiment of the method according to the invention.

In FIGS. 1-3, in each case 1 is a filling element, which together with a container support 2 provided beneath this filling element forms a filling point, which is for example an integral part of a rotary-type filling machine and to this end is provided, in the way known in principle to the person skilled in the art, with a plurality of filling points of the same type on the perimeter of a rotor, not shown, which can be driven in rotation about a vertical machine axis. The filling element 1 serves to fill containers in the form of bottles 3 in an open jet filling process with a liquid filling material, consisting of two components A and B, which are not combined or mixed until they are in the respective bottle 3.

For filling, the respective bottle 3 is arranged standing upright, i.e. with its bottle axis in the vertical direction and along the same axis or essentially along the same axis with a filling element axis FA at the filling point so that the bottle mouth 3.1 lies directly opposite a dispensing opening 4 formed on the underside of the filling element 1 for the liquid filling material, and in the open jet filling shown, at a distance from this dispensing opening 4. The bottle 3 thereby stands with its bottle base 3.2 on the container support 2 or on an electrical weighing device 5 forming a bottle pad, the measurement signal from which is used to control the filling element 1, i.e. for mass-controlled dispensing of components A and B of the liquid filling material into the bottles 3.

A fluid channel 7 which has the dispensing opening 4 is formed in a housing 6 of the filling element 1, and this channel can be connected in controlled fashion, via two fluid valves 10 and 11, each having an independent control and actuation device 8 and 9 respectively, with a channel 12 to supply component A (fluid valves 10) and with a channel 13 to supply component B (fluid valve 11). The channel 12 is connected to a boiling vessel common to all the filling elements 1 of the filling machine, containing component A. In similar fashion, the channel 13 is connected with a further boiling vessel, likewise common to all the filling elements of the filling machine, containing component B. In particular, in order to avoid any emptying of the fluid channel 7 and dripping of the liquid filling material at the end of the respective filling cycle, a gas trap 14 is arranged in the dispensing opening 4, said trap consisting in the simplest case of a sieve-like insert, but preferably of an insert which has a plurality of channels, each of which is open to the fluid channel 7 and also on the underside of the filling element 1 and which are traversed when components A and B are being filled.

The aim is to combine or to mix both components A and B only in the respective bottle 3 to be filled, so as e.g. to avoid a component, for example component A, when the fluid valve 11 is open, undesirably getting into the channel 13 for component B or vice versa. For this reason, for example, any mixing of the components in the fluid channel 7 is also not desired. A further aim is to introduce components A and B individually and sequentially into the respective bottle 3, so as to be able to control or regulate the filling quantity of each of component A and B precisely.

In the method shown in positions a)-d) in FIG. 2, each bottle 3 is firstly filled, by controlled opening and closing of the fluid valve 10, with the first part-quantity of component A for the desired mix ratio and then by the full quantity of component B and after that filled with the necessary remaining part-quantity of component A in the bottle 3. To do so, at the start of each filling cycle the fluid valve 10 is opened with the control and actuation device 8 (position a in FIG. 2) and then, on reaching the desired proportion of component A, closed again. The fluid valve 11 is opened in sequence with the control and actuation device 9 to introduce component B (position b in FIG. 2) and then closed again on reaching the desired proportion of component B. In this state, the bottle 2 has not yet been completely filled. Thereafter, there is therefore a residual filling, but with component A by again opening the fluid valve 10 with the control device 8 (position c in FIG. 2). As soon as the necessary complete fill quantity is in the bottle 3 as the result of this residual filling, the fluid valve 10 is closed again via the control device 8 (position d in FIG. 2), which completes the filling cycle and a new filling cycle can be started, to fill a further bottle 3.

Using this filling method as shown in FIG. 2, at the end of each filling cycle the fluid channel 7 contains component A, with which the filling of a further bottle 3 or the respective following filling cycle is started. As a result, in particular, gas traps 14 can be used on the filling elements 1 and it is not necessary to empty the fluid channel 7 at the end of each filling cycle, on the contrary, the fluid channel 7 above the gas trap 14 can remain filled with the filling material, i.e. with component A.

FIG. 3 shows, in an illustration similar to FIG. 2 in positions *a*1)-*c*1) and *a*2)-*c*2), various method steps which, in a further embodiment of the method according to the invention, are carried out using the filling point composed of the filling element 1 and the container support 3 in two consecutive filling cycles.

In a first filling cycle, the filling of the bottle 3 concerned takes place, starting with component A, for which the fluid valve 10 is opened via the control device 8 (position a1 in FIG. 3). After reaching the filling quantity specified for component A, the fluid valve 10 is closed, after which the fluid valve 11 is opened (position b1 in FIG. 3). After reaching the necessary total fill quantity, the filling cycle is ended by closing the fluid valve 11 (position c1 in FIG. 3). The fluid channel 7 above the gas trap 14 is then filled with component B.

A subsequent filling cycle to fill a further bottle 3 begins with the opening of the fluid valve 11 by the control device 9 to feed component B into the bottle 3 (position a2 in FIG. 3). After introducing the necessary quantity of component B, the fluid valve 11 is closed and then the fluid valve 10 is opened in order to introduce component A (position b2 in FIG. 3). This filling cycle is ended, once the total fill quantity is reached, by closing the fluid valve 10 (position c2 in FIG. 3), so that component A, with which the next filling cycle is begun for filling a further bottle 3, is then situated in the fluid channel 7 above the vapour trap 14.

In the method shown in FIG. 3, thus, the filling sequences or filling cycles are inverted by the central control device of the filling machine (filling computer) controlling the respective filling element 1 and thereby, as the result of corresponding triggering of the fluid valves 10 and 11, the correct filling quantities are assigned to the individual method steps, taking account of the signals delivered by the respective weighing device 5. Using this method also ensures that at the end of each filling cycle, only or essentially only one of the two components A or B is situated in the fluid channel 7 above the gas trap 14, so there is no need to empty the fluid channel 7 at the end of each filling cycle.

Since at the end of each filling cycle the respective fluid channel 7 or 7.1 and 7.2 each contain only one component A or B, but never a mixture of these components, reproducible starting conditions for each filling cycle are created, so that an exact control or regulation of the filling quantities of the two components introduced into the bottles and hence an exact mix ratio of these components in the bottles 3 is possible.

Figure 5:
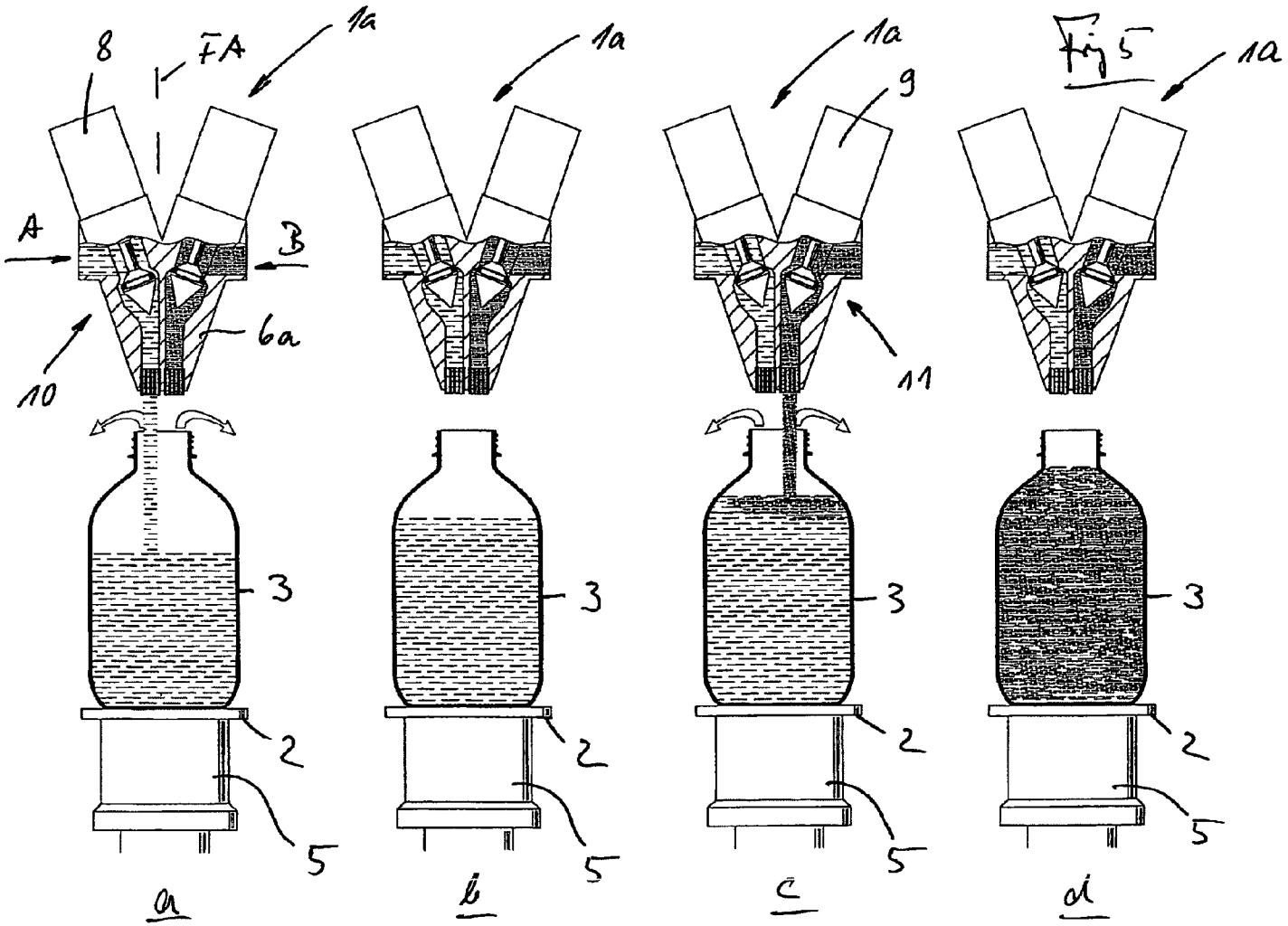
FIG. 5 positions *a*)-*d*) various method steps of a filling cycle in an embodiment of the method according to the invention using the filling element from FIG. 4.
Figure 7:
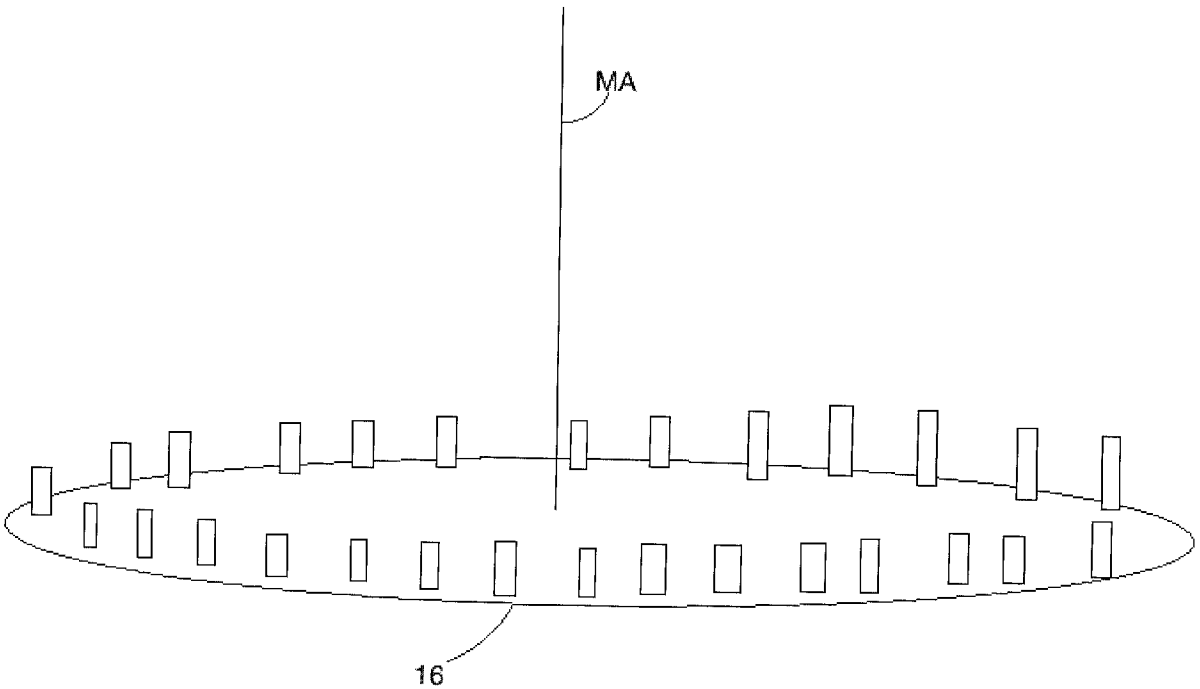
FIG. 7 shows a filling machine.

FIG. 5 shows in positions a)-d) various method steps of a further method according to the invention. This method uses in each case one filling point, which for example is again provided at the perimeter of a rotor 16 as shown in FIG. 7, which can be driven in rotation about a vertical machine axis MA, together with a plurality of similar filling points, but instead of the filling element 1 has a filling element 1*a*.

Figure 4:
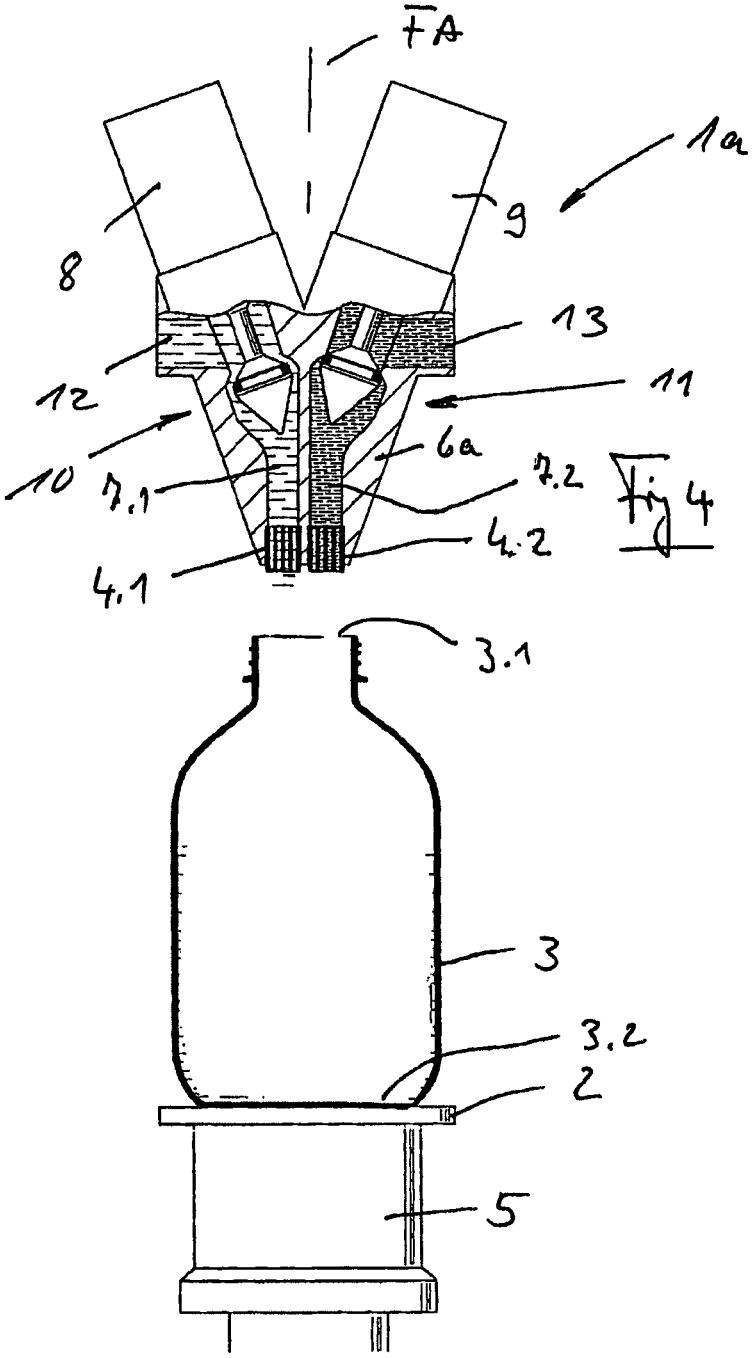
FIG. 4 in simplified view, a filling element together with a container in the form of a bottle.

As FIG. 4 also shows in particular, the filling element 1*a* differs from the filling element 1 in essence only in that in the housing 6*a* of the filling element 1*a*, two separate fluid channels 7.1 and 7.2 are formed, of which the fluid channel 7.1 forms a dispensing opening 4.1 and the fluid channel 7.2 forms a dispensing opening 4.2 on the underside of the filling element 1*a*. Each of the two dispensing openings 4.1 and 4.2 is provided with a gas trap 14 and arranged so that the bottle 3 positioned at the filling point lies with its bottle opening 3.1 opposite both dispensing openings 4.1 and 4.2. The fluid channel 7.1 is connectable in a controlled manner via the fluid valve 10 actuated by the control element 8 with the channel 12 for component A and the fluid channel 7.2 via the fluid valve 11 actuated by the control element 9 with the channel 13 for component B.

As shown in FIG. 5, the filling of the respective bottle 3 with components A and B again takes place in sequence, for example beginning with component A by opening the fluid valve 10 (position a in FIG. 5). Once the necessary filling quantity of component A is reached, the fluid valve 10 is closed (position b in FIG. 5) after which the fluid valve 11 is opened in order to introduce component B into the bottle 3 (position c in FIG. 5). Once the necessary total fill quantity has been reached the fluid valve 11 is also closed at the end of the filling cycle (position d in FIG. 5).

At the end of each filling cycle, both fluid channels 7.1 and 7.2 above the gas trap 14 are filled, and each fluid channel 7.1 or 7.2 only with the respective component A or B assigned to it.

In all of the embodiments described above, the controlled closing of the fluid valves 10 and 11 takes place as a function of the filling quantity introduced in each case into the respective bottle 3, triggered by the measuring signal delivered by the weighing device 5.

In order to enable a precise measurement of the respective filling quantity introduced, and thereby in particular also the quantity of the component first introduced in the respective filling cycle, by using the respective weighing device 5, it is necessary when using the method described above, but at least useful, that, within each filling cycle, after introducing the first component, a filling pause is inserted, as indicated in the method shown in FIG. 5 by position *b*. A filling pause of this type would then be provided in similar fashion in the method shown in FIG. 2, following closure of the fluid valve 10 and before opening the fluid valve 11, i.e. immediately before position c in FIG. 2. In the method shown in FIG. 3, a filling pause would be provided in the first filling cycle following closure of the fluid valve 10 and before opening the fluid valve 11, i.e. before the method step in position b1, and in the subsequent filling cycle after closing the fluid valve 11 and before opening the fluid valve 10, i.e. before the method step in position b2.

The precise measurement of the filling quantities introduced makes it possible e.g. to undertake a corrective filling, for example with the first or last introduced component. Precise measurement of the filling quantities introduced also makes it possible, e.g. with the measured values from a filling cycle, to conduct a correction of the filling quantities in the respective subsequent filling cycle or else to document the actual filling quantities and their deviation from desired values for filling quantities, etc.

Especially in the case of filling machines for filling containers in the form of bottles 3, the filling element 1 has the advantage over the filling element 1*a* that in the filling element 1, the cross section of flow of the dispensing opening 4 can adapted to the cross section of the bottle opening 3.1 by being selected to be as large as possible, so that for both components A and B a dispensing opening 4 with a large cross section is produced. In the case of the filling element 1*a*, however, the cross sections of flow of both dispensing openings 4.1 and 4.2 must together be adapted to the cross section of the bottle opening 3.1, as the result of which a reduced cross section of flow arises for each dispensing opening 4.1 and 4.2 compared with the dispensing opening 4. When filling containers in the form of bottles 3, higher performance (filled filling material quantity or filled bottles 3 per unit of time) is thus possible in principle with a filling machine containing the filling elements 1 than with a filling machine containing the filling elements 1*a*, and this applies when the construction size of the filling machine and of the rotor with the filling elements are the same.

Figure 6:
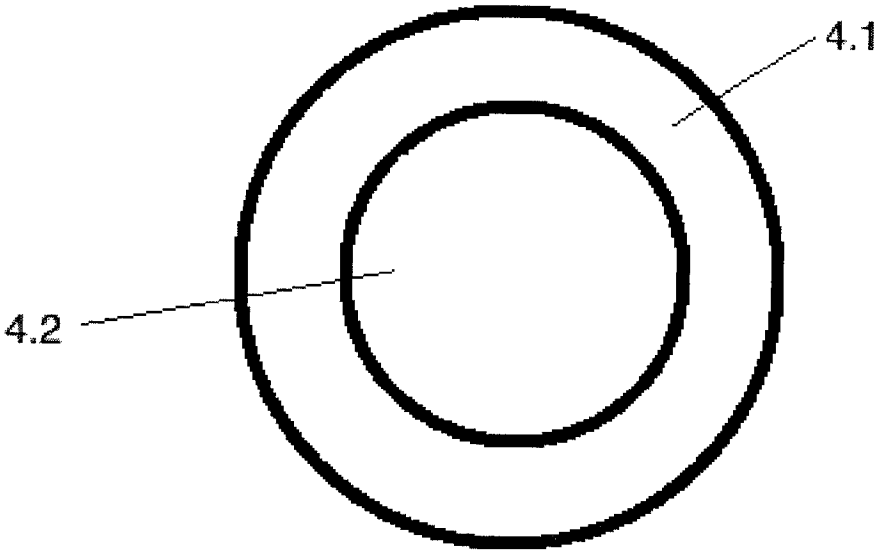
FIG. 6 shows an annular valve.

In FIGS. 4 and 5 the two dispensing openings 4.1 and 4.2 are shown side by side. In principle it is also possible to embody the filling element 1*a* so that one of the two dispensing openings, for example dispensing opening 4.1, surrounds the other dispensing opening, for example dispensing opening 4.2 in the form of a ring, i.e. as an annular outlet, as shown in FIG. 6. Accordingly, the gas trap 14 provided in the dispensing opening 4.2 is then also annular in form.

There is also the option of providing the two dispensing openings 4.1 and 4.2, in particular when the dispensing opening 4.2 is annular in form, at different levels, for example dispensing opening 4.1 is set back, i.e. at a greater distance from the bottle opening 3.1 than the dispensing opening 4.2.

There is also the option, both for the filling element 1 and for filling element 1*a*, of embodying the dispensing openings 4.1 and 4.2 adjustably in the direction of the filling element axis FA, and in particular such that the respective gas trap 14 is arranged to be axially adjustable in the section of the associated fluid channel 7, 7.1 and 7.2 respectively forming the dispensing opening 4, 4.1 and 4.2.

Each filling element 1 and 1 a is also designed so that, in particular on the areas coming into contact with the filling material or components A and B, it can be cleaned, rinsed and/or disinfected with a gaseous, vaporous and/or liquid medium, for example also with water, hydrogen peroxide ($H_2O_2$), and in particular also in a CIP method.

The invention has been described above on the basis of exemplary embodiments. It goes without saying that amendments and modifications are possible without thereby departing from the basic concept of the invention.

LIST OF REFERENCE NUMBERS

1, 1*a* filling element
2 container support
3 bottle
3.1 bottle opening
3.2 bottle base
4, 4.1, 4.2 dispensing opening
5 weighing device
6, 6*a* housing
7, 7.1, 7.2 fluid channel
8, 9 control and actuation device
10, 11 fluid valve
12, 13 channel
14 gas trap
A, B components of the filling material
FA filling element axis

The invention claimed is:

1. A method for filling containers with a filling material using a filling element, said filling material comprising at least two components, the method comprising introducing said components separately into a respective container via said filling element, wherein said filling element comprises a fluid channel with a dispensing opening for dispensing said filling material into said respective container, and filling said fluid channel at the end of each filling cycle with that component with which a chronologically immediately subsequent filling cycle begins, wherein said component with which a chronologically immediately subsequent filling cycle begins changes from one filling cycle to the next, wherein filling said respective container comprises using a filling element that comprises a gas trap at said dispensing opening, said method further comprising, in each filling cycle introducing the components into the respective container consecutively in a predetermined sequence, and in a respective subsequent filling cycle following one filling cycle, modifying the sequence such that filling of the respective container in the subsequent filling cycle takes place using a sequentially last component from the preceding filling cycle.

2. The method according to, claim 1, further comprising introducing each of the components into the respective container in one of a volume-controlled fashion and a quantity-controlled fashion.

3. The method according to, claim 1, further comprising introducing the components into the respective container sequentially.

4. The method according to claim 3, wherein after introducing one component, starting the introduction of a subsequent component after a delay.

5. The method according to claim 1, further comprising using a filling element that has a separate fluid channel for each component or group of components, said fluid channel being connected in a controlled fashion with a feed for the component assigned to the respective fluid channel.

6. The method according to claim 1, further comprising, during sequential filling cycles, introducing each of the components in the same sequence into a container concerned, and ending each filling cycle with the sequentially first component.

7. The method according to claim 6, further comprising ending each filling cycle with a residual filling that takes place with the sequentially first component of the cycle.

8. The method according to claim 1, further comprising, during a filling cycle, introducing all components into a container concerned with the same filling element.

9. The method according to claim 1, wherein the filling material consists of two different components.

10. The method of claim 1, wherein the sequence is modified by being inverted.

* * * * *